US009357811B2

(12) United States Patent
Chiang

(10) Patent No.: US 9,357,811 B2
(45) Date of Patent: Jun. 7, 2016

(54) HEAD CIRCUMFERENCE ADJUSTMENT DEVICE OF A HELMET

(71) Applicant: UNITED ROYAL SPORTS INC., Taipei (TW)

(72) Inventor: Wen-Tsai Chiang, Taipei (TW)

(73) Assignee: United Royal Sports Inc., Taipei (TW)

( * ) Notice: Subject to any disclaimer, the term of this patent is extended or adjusted under 35 U.S.C. 154(b) by 213 days.

(21) Appl. No.: 14/027,460

(22) Filed: Sep. 16, 2013

(65) Prior Publication Data

US 2015/0074876 A1 Mar. 19, 2015

(51) Int. Cl.
*A42B 3/14* (2006.01)
*A42B 3/22* (2006.01)

(52) U.S. Cl.
CPC . *A42B 3/145* (2013.01); *A42B 3/14* (2013.01); *A42B 3/22* (2013.01)

(58) Field of Classification Search
CPC ..... A42B 1/22; A42B 3/14; A42B 3/145; A42B 3/147
USPC ..... 2/417, 418
See application file for complete search history.

(56) References Cited

U.S. PATENT DOCUMENTS 5,950,245 A * 9/1999 Binduga ..... 2/417
6,314,588 B1 * 11/2001 Fang ..... 2/418
7,174,575 B1 * 2/2007 Scherer ..... 2/418
7,707,695 B2 * 5/2010 Dubois ..... 24/68 B
8,434,200 B2 * 5/2013 Chen ..... 24/68 SK
2005/0262619 A1 * 12/2005 Musal et al. ..... 2/421
2006/0015986 A1 * 1/2006 Bielefeld ..... 2/181
2006/0225187 A1 * 10/2006 Wu ..... 2/425
2007/0266481 A1 * 11/2007 Alexander et al. ..... 2/414
2008/0092279 A1 * 4/2008 Chiang ..... 2/425
2008/0276354 A1 * 11/2008 Stokes et al. ..... 2/418
2008/0295229 A1 * 12/2008 Fang ..... 2/418
2009/0031482 A1 * 2/2009 Stokes et al. ..... 2/414
2009/0211385 A1 * 8/2009 Fiquepron et al. ..... 74/422
2010/0095438 A1 * 4/2010 Moelker ..... 2/418
2011/0088148 A1 * 4/2011 Chen ..... 2/418
2011/0191946 A1 * 8/2011 Fang ..... 2/418

* cited by examiner

*Primary Examiner* — Khaled Annis
(74) *Attorney, Agent, or Firm* — Rosenberg, Klein & Lee

(57) ABSTRACT

A head circumference adjustment device of a helmet includes: a main body formed with a cavity; an annular strap having a first end and a second end passing through the cavity, each of the first and second ends being formed with a rack section, a thumb section and a shoulder section; and a controller mounted in the cavity. The controller has a gear engaged with the rack sections of the strap. By means of rotating the controller, the position of the strap can be adjusted to adjust the head circumference. The head circumference adjustment device can be easily operated and truly fixed to overcome the shortcomings existing in the conventional adjustment device that the strap is likely to slip and the position of the strap can be hardly truly adjusted and the strap is likely to detach from the adjustment device.

25 Claims, 7 Drawing Sheets

HEAD CIRCUMFERENCE ADJUSTMENT DEVICE OF A HELMET

BACKGROUND OF THE INVENTION

1. Field of the Invention

The present invention relates generally to a head circumference adjustment device of a helmet. The adjustment device includes a main body formed with a cavity, an annular strap having a first end and a second end passing through the cavity, and a controller mounted in the cavity. Each of the first and second ends is formed with a rack sect ion, a thumb sect ion and a shoulder sect ion. The controller has a gear engaged with the rack sections of the strap. By means of rotating the controller, the position of the strap can be adjusted to adjust the head circumference. The head circumference adjustment device can be easily operated and truly fixed.

2. Description of the Related Art

A conventional helmet is formed from a blank of plastic casing. The plastic casing is fixed in a vacuum molding device and a foam material is injected into the plastic casing. After heated, the plastic casing encloses the foam material to form the helmet structure for a user to wear. In general, a hoop or a strap for adjusting the head circumference is mounted in the conventional helmet for fixing the helmet on a user's head. For example, US 2006/0225187 A1 discloses a sports helmet having a strap for adjusting the head circumference.

An upper rack section and a lower rack section are respectively disposed in the elongated closed holes of two ends of the strap. The two end sections of the strap are back and forth overlapped with each other and mounted in the case of the adjustment device to define an elongated hole with rack sections for engaging with a gear of a rotary disc. When rotating the adjustment button on the case, the gear of the rotary disc is driven to drive the annular rack sections for fastening or unfastening the strap according to the head circumference of the user.

In order to smoothly plug the two end sections (back and forth overlapped) of the strap into the case, the case is designed with a size considerably larger than the thickness or size of the two overlapped end sections of the strap. Under such circumstance, the two end sections of the strap are very likely to up and down displace within the case. As a result, the elongated hole with rack sections can be hardly accurately defined by the upper and lower rack sections. Therefore, the upper and lower rack sections can hardly stably engage with the gear of the rotary disc. When operating the rotary disc, slippage often takes place so that the position of the strap can be hardly truly adjusted and fixed.

In order to solve the above problem, some head circumference adjustment devices of helmets have been disclosed. For example, U.S. Pat. No. 8,370,967 B2 discloses an adjustable head band for a helmet. Two end sections of the band are respectively formed with an upper rack section and a lower rack section. After the upper and lower rack sections are up and down inserted into the case, the bosses in the case press the upper and lower rack sections to avoid displacement thereof. Accordingly, the upper and lower rack sections can truly define an elongated hole with rack sections.

However, as well known by those skilled in this field, the two end sections of the strap are disconnected from each other and movable relative to each other so that the strap can be fastened or unfastened by means of rotating the rotary disc. Under such circumstance, when a user operates (unfastens) the strap, the two end sections of the strap often detach out of the case of the adjustment device due to negligence. This is not what we expect.

It is therefore tried by the applicant to provide a head circumference adjustment device of a helmet to overcome the above problems existing in the prior art.

In the head circumference adjustment device of the helmet:

1. The two ends of the strap are different from the two end sections of the strap of the conventional adjustment device. It is unnecessary to back and forth overlap the two end sections of the strap to insert the two end sections into the case of the adjustment device. Accordingly, the error in adaptation of the two ends of the strap to the case can be minimized and the slippage can be avoided. Therefore, the strap can be truly adjusted.
2. The cooperation structures of the adjustment device and the strap are different from the conventional device so that in operation, the two end sections of the strap are prevented from detaching out of the case of the adjustment device due to negligence.

SUMMARY OF THE INVENTION

It is therefore a primary object of the present invention to provide a head circumference adjustment device of a helmet. The adjustment device includes: a main body formed with a cavity; an annular strap having a transversely narrowed first end and a transversely narrowed second end reciprocally movably passing through the cavity, each of the first and second ends being formed with a rack section, a thumb section and a shoulder section; and a controller mounted in the cavity. The controller has a gear engaged with the rack sections of the strap. By means of rotating the controller, the position of the strap can be adjusted to adjust the head circumference. The head circumference adjustment device can be easily operated and truly fixed to overcome the shortcomings existing in the conventional adjustment device that the strap is likely to slip and the position of the strap can be hardly truly adjusted and the strap is likely to detach from the adjustment device.

In certain embodiments, the thumb section is located at a distal end of each of the first and second end portions and extends with a greater transverse width than the rack section.

In the above head circumference adjustment device, the cavity has a peripheral wall and a bottom section. The peripheral wall of the cavity is formed with opposite slots for the first and second ends of the strap to pass through. The main body is formed with a first rail and a second rail for guiding the strap to move in a moving path.

In the above head circumference adjustment device, the thumb section of the strap has a height larger than a height of the rack section. When the thumb section moves along the moving path and reaches the peripheral wall of the cavity, the thumb section is stopped by a restriction section formed on the peripheral wall. Accordingly, the strap is prevented from detaching out of the main body due to negligence.

In the above head circumference adjustment device, the controller has at least one cantilever and a gear engaged with the rack sect ions of the strap. The cantilever is formed with a recessed section in contact with an adjustment button and a restriction section formed at a free end of the cantilever for interfering with the peripheral wall of the cavity and locating the strap. When rotating the adjustment button, the controller is driven and rotated to move the strap so as to adjust the position thereof. The gear of the controller is more securely engaged with the rack sections of the strap.

The present invention can be best understood through the following description and accompanying drawings, wherein:

DETAILED DESCRIPTION OF THE PREFERRED EMBODIMENTS

Figure 1:
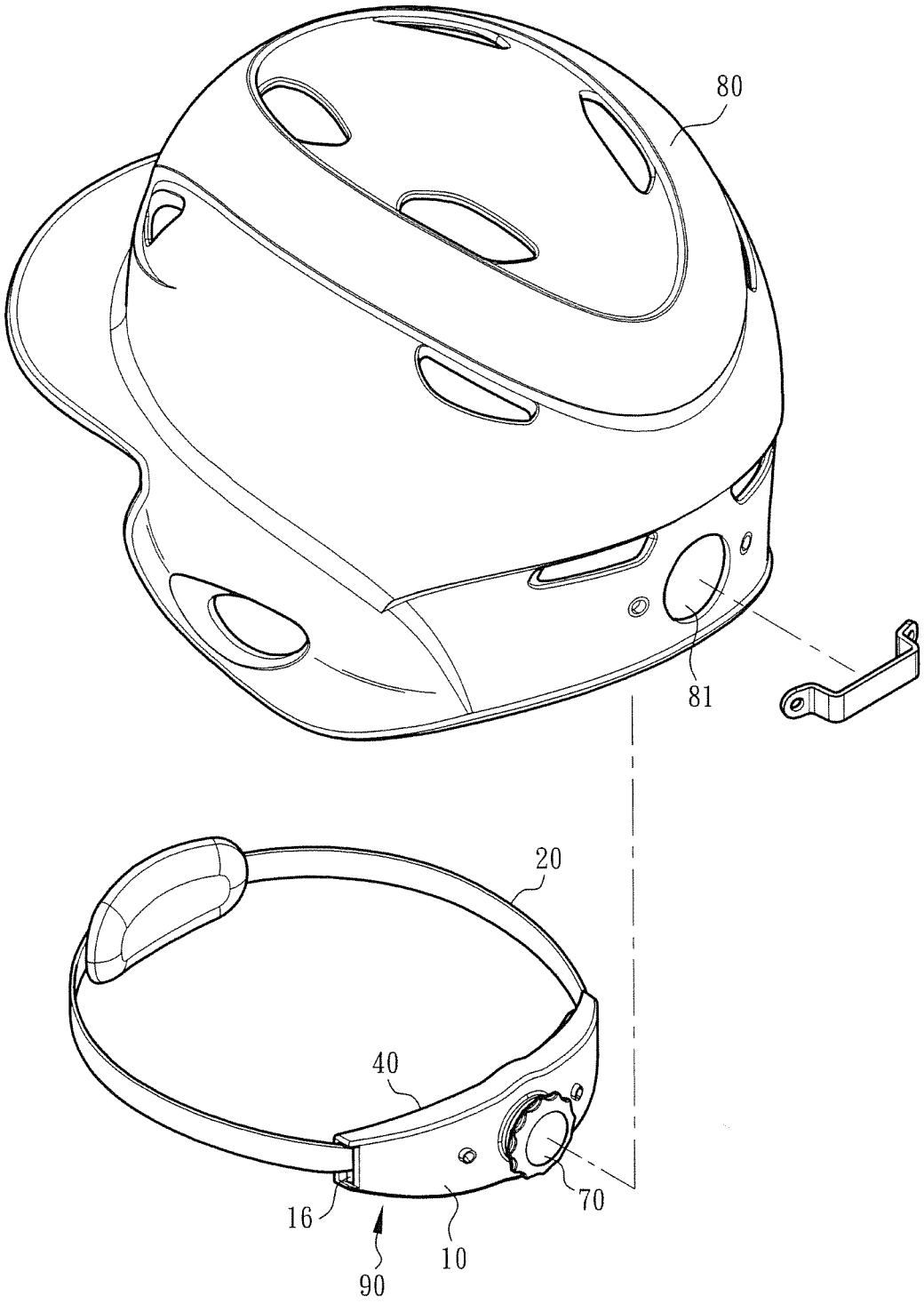
FIG. 1 is a perspective view showing that the adjustment device of the present invention is assembled with a helmet body.
Figure 2:
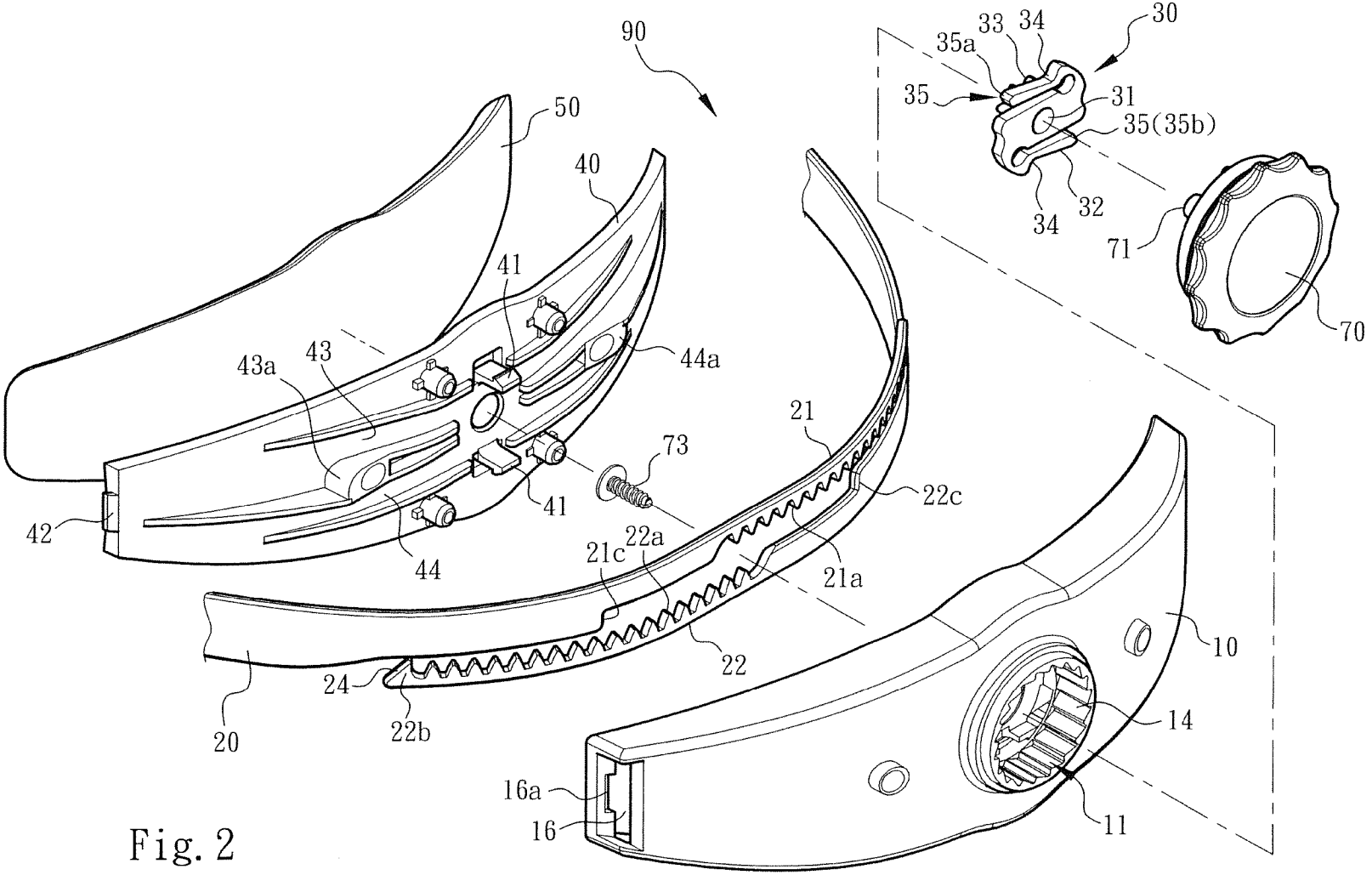
FIG. 2 is a perspective exploded view of the adjustment device of the present invention.
Figure 3:
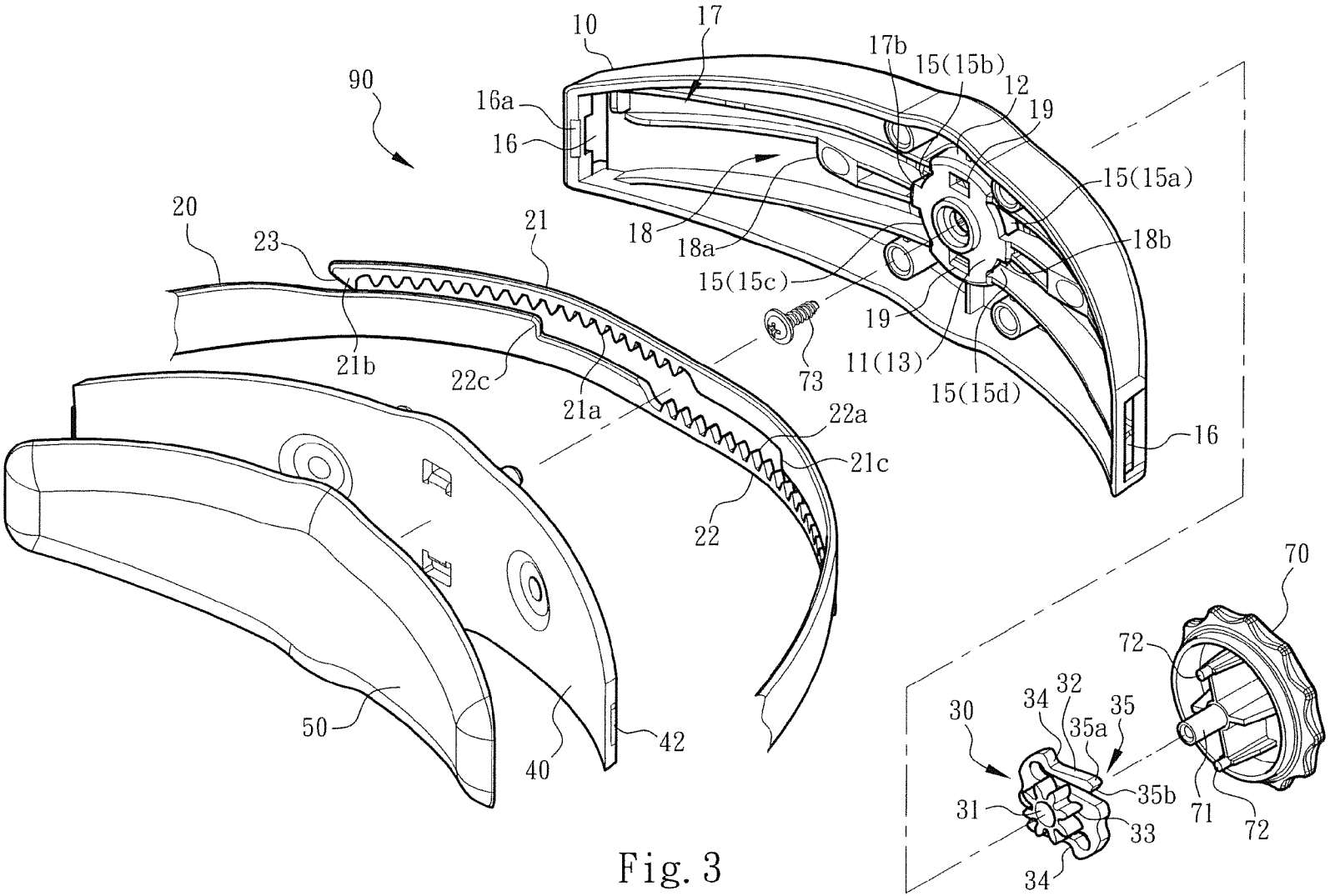
FIG. 3 is a perspective exploded view of the adjustment device of the present invention, seen from another angle, showing the structural arrangement of the main body of the adjustment device.

Please refer to FIGS. 1, 2 and 3. The head circumference adjustment device of the helmet of the present invention includes a helmet body 80 and an adjustment device 90. In practice, the adjustment device 90 is mounted in the helmet body 80 for adjusting the head circumference of the helmet body 80 for a user to suitably wear the helmet. The helmet body 80 is formed with an assembling hole 81. An adjustment button 70 of the adjustment device 90 is movably assembled in the assembling hole 81.

In this embodiment, the adjustment device 90 includes a main body 10, which is a rectangular case. Two ends of the main body 10 are formed with inlets 16 for a strap 20 to enter the main body 10. The main body 10 is formed with a circular cavity 11 having a peripheral wall 12 and a bottom section 13. Multiple toothed sections 14 are formed on inner circumference of the peripheral wall 12 of the cavity 11 for interfering with a controller 30. (This will be described hereinafter).

Referring to FIG. 3, the peripheral wall 12 is formed with opposite slots 15 (near the bottom section 13) for the strap 20 to pass through the cavity 11. To speak more specifically, according to FIG. 3, the slots 15 include a first slot 15*a* and a second slot 15*b* positioned on upper section of the cavity 11 and a third slot 15*c* and a fourth slot 15*d* positioned on lower section of the cavity 11. In this embodiment, the main body 10 is formed with a first rail 17 between the inlets 16 and the first and second slots 15*a*, 15*b* and a second rail 18 between the inlets 16 and the third and fourth slots 15*c*, 15*d*. The first and second rails 17, 18 serve to guide the strap 20 to move in a moving path. The first and second rails 17, 18 are respectively provided with stop sections 17*a*, 18*a* in the moving path of the strap 20.

In a preferred embodiment, the first and second rails 17, 18 are further provided with restriction sections 17*b*, 18*b* formed on the peripheral wall 12 of the cavity for preventing the strap 20 from detaching from the main body 10.

Please refer to FIGS. 2 and 3. The strap 20 is in an annular form and has a first end 21 and a second end 22. The strap 20 is reciprocally movably passed through the cavity 11. Substantially, the first and second ends 21, 22 separate from each other and up and down overlap each other. The first end 21 enters the main body 10 from the inlet 16 and extends along the first rail 17 through the first slot 15*a* into the cavity 11 and then passes through the second slot 15*b*. The second end 22 enters the main body 10 from the other inlet 16 and extends along the second rail 18 through the third slot 15*c* into the cavity 11 and then passes through the fourth slot 15*d*.

Each of the first and second ends 21, 22 is formed with a rack sect ion 21*a*, 22*a*, a thumb section 21*b*, 22*b* connected with the rack section 21*a*, 22*a* and positioned at a free end and a shoulder section 21*c*, 22*c* opposite to the thumb section 21*b*, 22*b*. When rotating the controller 30, the rack sections 21*a*, 22*a* are driven to move the strap 20 and adjust the head circumference. The thumb sections 21*b*, 22*b* and the shoulder sections 21*c*, 22*c* serve to restrict the move range of the strap 20.

As shown in FIGS. 2 and 3, a back cover 40 is assembled with the main body 10 to seal the main body 10. The back cover 40 is a rectangular board body with a configuration identical to that of the main body 10. The back cover 40 is formed with claw sections 41 and insertion blocks 42 at two ends. The claw sections 41 are inserted in sockets 19 formed on the bottom section 13 of the cavity. The insertion blocks 42 are inserted in dents 16*a* formed at two ends of the main body 10.

Preferably, the back cover 40 is formed with a first rail 43, a second rail 44 and stop sections 43*a*, 44*a* corresponding to the first and second rails 17, 18 and the stop sections 17*a*, 18*a* of the main body 10. Accordingly, the back cover 40 and the main body 10 are closely mated with each other. Preferably, a subsidiary cover 50 is connected with the back cover 40.

In this embodiment, the controller 30 is mounted in the cavity 11. The controller 30 is a tray-shaped member formed with a shaft hole 31. A shaft 71 of the adjustment button 70 is assembled in the shaft hole 31 by means of a fastening member 73 to connect the controller 30 with the adjustment button 70. The controller 30 includes at least one cantilever 32 and a gear 33 engaged with the rack sections 21*a*, 22*a* of the strap. In this embodiment, the controller 30 has two symmetrical cantilevers 32 with an elastic displacement range.

In this embodiment, the cantilever 32 is formed with a recessed section 34 and a restriction section 35 formed at a free end of the cantilever 32. The restriction section 35 has a wedged configuration having a first face 35*a* and a second face 35*b*.

With an axial direction of the cantilever 32 as a reference axis, the first face 35*a* (inclination) and the axis of the cantilever 32 contain an angle smaller than an angle contained between the second face 35*b* (inclination) and the axis of the cantilever 32. Therefore, the first face 35*a* will interfere with the toothed sections 14 of the cavity, permitting the controller 30 to rotate within the cavity 11. The second face 35*b* interferes with the toothed sections 14 of the cavity to stop the controller 30 from rotating within the cavity 11 and achieve a locating effect and enhance the stability of engagement between the gear 33 of the controller and the rack sections 21*a*, 22*a* of the strap. Only when an action force is applied to the cantilever 32 to press down the cantilever 32, the second face 35*b* is released from the interference of the toothed sections 14 of the cavity, permitting the controller 30 to rotate.

Figure 4:
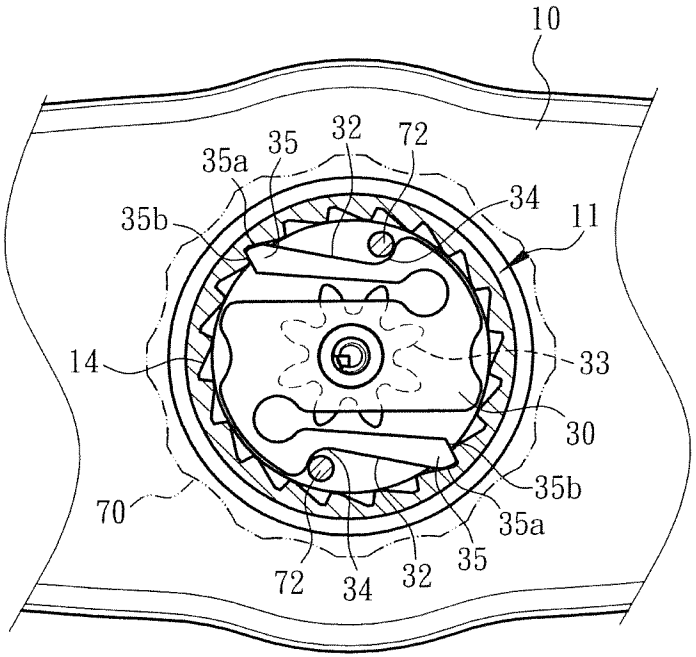
FIG. 4 is a plane view of the present invention, showing the cooperation between the controller and the cavity of the main body.

Please refer to FIGS. 3 and 4. The adjustment button 70 has at least one press section 72 corresponding to the recessed section 34 of the cantilever of the controller 30. The press sections 72 are two bosses positioned on the recessed section 34. When the adjustment button 70 is rotated, the press sections 72 press down the cantilevers 32 to make the restriction sections 35 of the cantilevers separate from the toothed sections 14 of the cavity.

Figure 5:
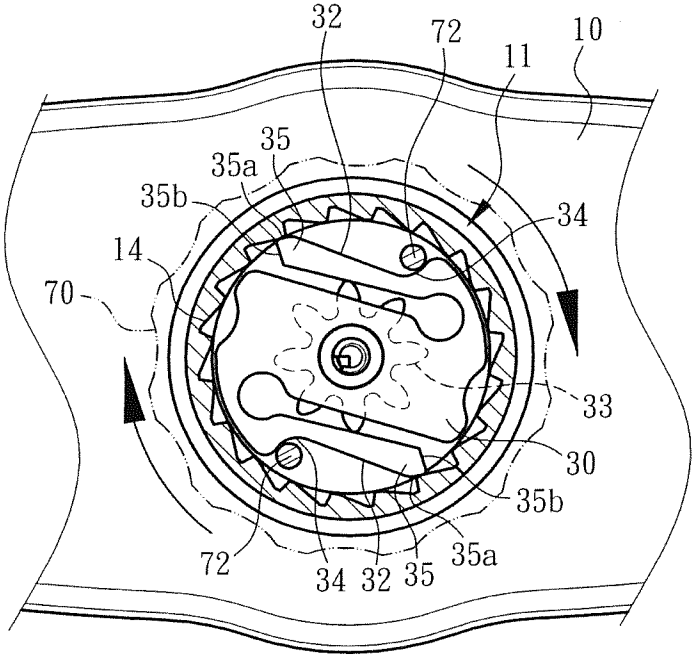
FIG. 5 is a plane view according to FIG. 4, showing that the adjustment button is rotated to drive the controller to rotate within the cavity.

Please now refer to FIG. 5. With the direction of the adjustment button 70 and the controller 30 as a reference direction, when a user rotates the adjustment button 70 to make the press section 72 drive the controller 30 clockwise rotate, the first face 35*a* of the restriction section 35 of the cantilever such interferes with the toothed section 14 of the cavity that the controller 30 is permitted to rotate. In this case, the gear 33 can drive the rack sections 21*a*, 22*a* of the strap to respectively move along the first and second rails 17, 18 relative to each other so as to gradually minify the head circumference defined by the strap 20.

Figure 6:
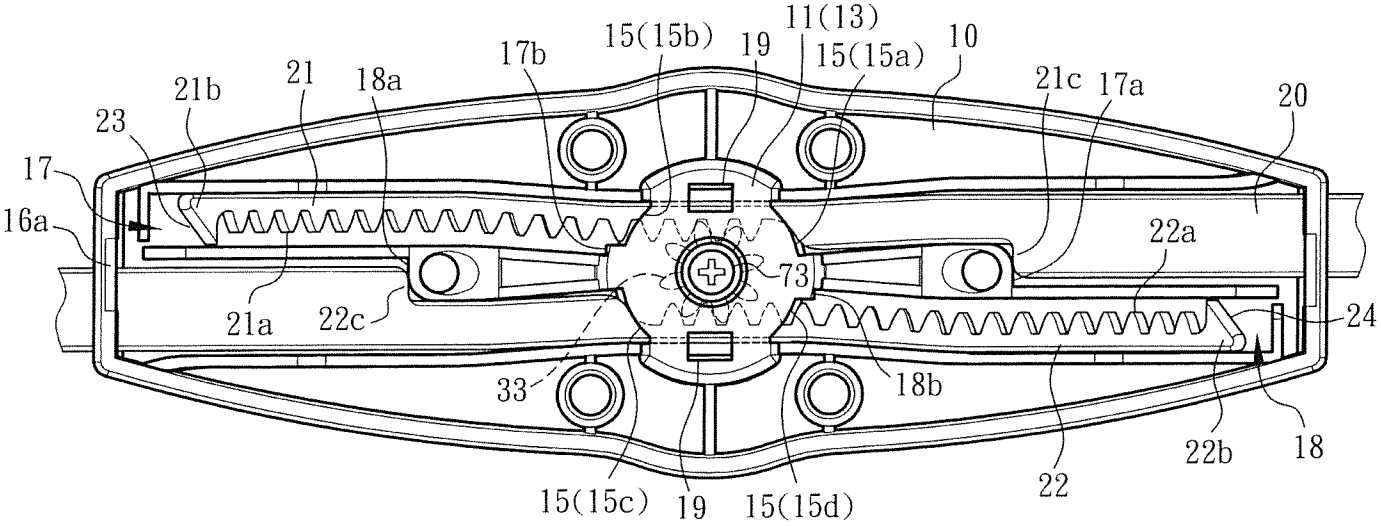
FIG. 6 is a plane view of the present invention, showing that the strap is driven by the gear of the controller and the shoulder sections of the strap are stopped by the stop sections of the main body of the adjustment device.

Referring to FIG. 6, when the shoulder sections 21*c*, 22*c* of the first and second ends 21, 22 of the strap respectively reach the stop sections 17*a*, 18*a* of the first and second rails 17, 18, the stop sections 17*a*, 18*a* will stop the strap 20 from further moving. Under such circumstance, the head circumference defined by the strap 20 is adjusted to a minimum size.

Figure 7:
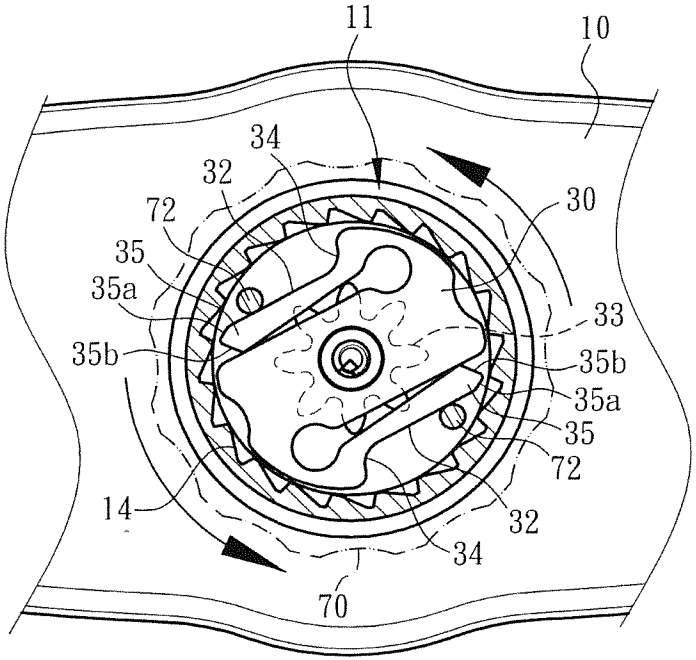
FIG. 7 is a plane view according to FIG. 4, showing that the adjustment button is rotated to press down the cantilevers of the controller, permitting the controller to be rotated in another direction.

Please now refer to FIG. 7. When the user rotates the adjustment button 70 to make the press section 72 drive the controller 30 counterclockwise rotate, the press section 72 of the adjustment button 70 gradually presses down the cantilever 32 to make the second face 35*b* of the restriction section 35 separate from the toothed sections 14 of the cavity, whereby the second face 35*b* is released from the interference of the toothed sections 14, permitting the controller 30 to rotate. In this case, the gear 33 of the controller can drive the rack sections 21*a*, 22*a* of the strap to respectively move along the first and second rails 17, 18 relative to each other so as to gradually magnify the head circumference defined by the strap 20.

Figure 8:
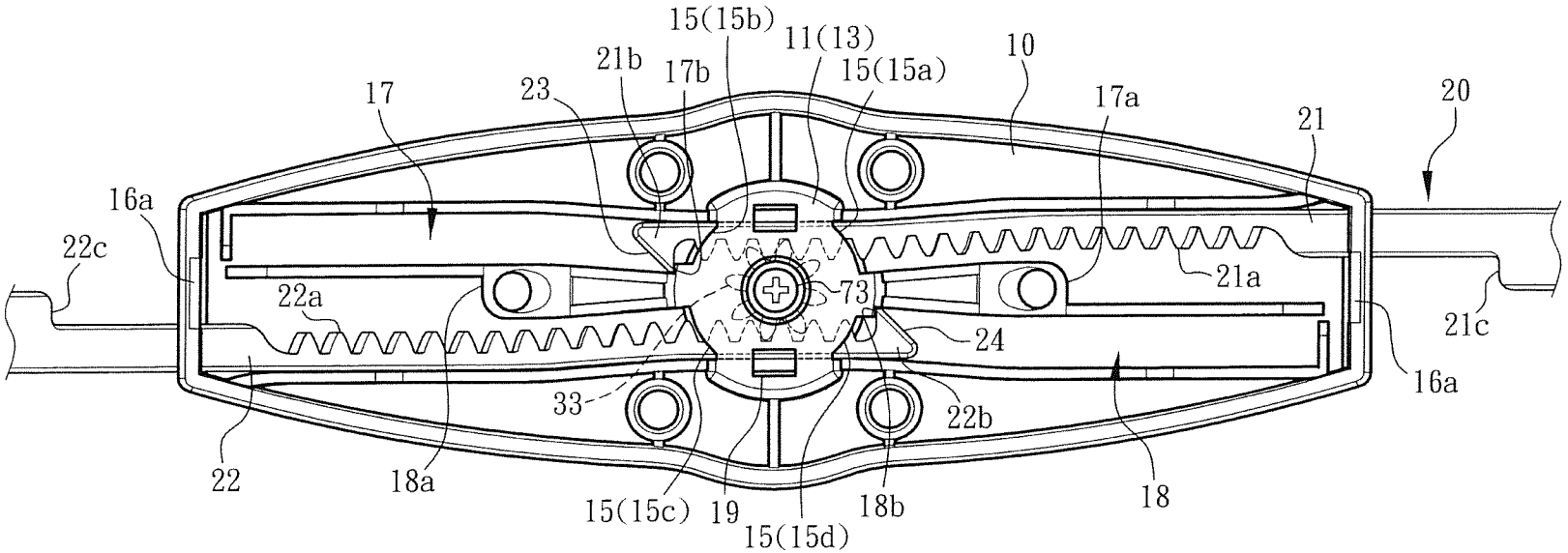
FIG. 8 is a plane view according to FIG. 6, showing that the strap is driven by the gear of the controller and the thumb sections of the strap are stopped by the restriction sections of the main body of the adjustment device.

Referring to FIG. 8, when the thumb sections 21*b*, 22*b* of the first and second ends 21, 22 of the strap respectively reach the restriction sections 17*b*, 18*b* of the cavity 11, the restriction sections 17*b*, 18*b* stop the strap 20 from further moving. Under such circumstance, the head circumference defined by the strap 20 is adjusted to a maximum size.

In a preferred embodiment, with the direction of FIG. 8 as a reference direction, the thumb section 21*b* at the free end of the first end 21 of the strap provides a downward elastic action force, while the thumb section 22*b* at the free end of the second end 22 of the strap provides an upward elastic action force. When the thumb sections 21*b*, 22*b* reach the restriction sections 17*b*, 18*b* of the cavity 11, this helps the restriction sections 17*b*, 18*b* to more securely interfere with and stop the thumb sections 21*b*, 22*b* so as to ensure that the strap 20 is kept in the main body 10.

In a preferred embodiment, each of the thumb sections 21*b*, 22*b* of the strap has a slope 23, 24, whereby the first end 21 of the strap can smoothly enter the cavity 11 from the first slot 15*a* and pass through the second slot 15*b* and the second end 22 can smoothly enter the cavity 11 from the third slot 15*c* and pass through the fourth slot 15*d*.

It should be noted that the restriction sections 17*b*, 18*b* of the peripheral wall 12 of the cavity are respectively in adjacency to the first slot 15*a* and the fourth slot 15*d*. The first slot 15*a* (or the fourth slot 15*d*) has a vertical height slightly larger than the height of the rack section 21*a* (or 22*a*) of the strap, (that is, the length from the tooth root to the tooth crest), but smaller than the height of the thumb section 21*b* (or 22*b*) of the strap. Therefore, when the thumb sect ion 21*b* (or 22*b*) of the strap reaches the cavity 11, the restriction section 17*b* (or 18*b*) will stop the thumb section 21*b* (or 22*b*) to prevent the strap from being extracted out of the main body 10.

In comparison with the prior art, the head circumference adjustment device of the helmet of the present invention has the following advantages:

1. The main body 10, the strap 20, the controller 30 and the relevant components of the present invention are redesigned. The main body 10 is formed with the cavity 11 and the toothed sections 14. The controller 30 is formed with the cantilevers 32 and the restriction sections 35. The main body 10 is provided with the first and second rails 17, 18 and the cavity 11 is formed with the first to the fourth slots 15*a*-15*d*. The restriction sections 17*b*, 18*b* cooperate with the thumb sections 21*b*, 22*b* of the strap 20. This is obviously different from the prior art (such as US 2006/0225187 A1) in which an upper rack section and a lower rack section are respectively disposed in the elongated closed holes of two ends of the strap. The two end sections of the strap are back and forth overlapped with each other and inserted into the case of the adjustment device. The rotary disc is formed with hook sections and protrusions formed on the hook sections. The adjustment button is formed with bosses, which move around the hook sections to force the protrusions to disengage from the ratchets of the case of the adjustment device. Also, the present invention is obviously different from the prior art (such as U.S. Pat. No. 8,370,967 B2) in which two end sect ions of the band are respectively formed with an upper rack section and a lower rack section. After the upper and lower rack sections are up and down inserted into the case, the bosses in the case press the upper and lower rack sections to avoid displacement thereof. The circumference of the rotary disc is formed with toothed sections engaged with the ratchets of the case and the adjustment button for adjusting the position of the band.
2. The strap 20 of the adjustment device 90 is restricted to move within the first and second rails 17, 18. In cooperation with the cavity 11 and the first to the fourth slots 15*a*-15*d*, the rack sections 21*a*, 22*a* of the strap are truly engaged with the gear 33 of the controller. This overcomes the shortcomings existing in the prior art that there is error in the adaptation of the two end sections of the strap to the case and the two end sections of the strap are very likely to up and down displace within the case. As a result, the elongated hole with rack sections can be hardly accurately defined by the upper and lower rack sections. Therefore, the upper and lower rack sections can hardly stably engage with the gear of the rotary disc. When operating the rotary disc, slippage often takes place so that the position of the strap can be hardly truly adjusted and fixed.
3. The cavity 11 of the adjustment device 90 is formed with the restriction sections 17*b*, 18*b* and the strap 20 is formed with the thumb sections 21*b*, 22*b* in cooperation with the restriction sections 17*b*, 18*b*. This solves the problem existing in the prior art (such as U.S. Pat. No. 8,370,967 B2) that the two end sections of the strap are disconnected from each other so that when a user unfastens the strap, the two end sections of the strap often detach out of the case of the adjustment device due to negligence.

The above embodiments are only used to illustrate the present invention, not intended to limit the scope thereof. Many modifications of the above embodiments can be made without depart ing from the spirit of the present invention.

What is claimed is:

1. A head circumference adjustment device of a helmet, comprising:

a main body formed with a substantially enclosed cavity, the cavity being bounded by a peripheral wall and a bottom section, multiple toothed sections being formed on an inner circumference of the peripheral wall about the cavity, the main body defining first and second slots communicating with the cavity;

a strap having a transversely narrowed first end portion and a transversely narrowed second end portion each configured for insert through one of the first and second slots into the cavity, each of the first and second ends portions being formed with a rack section extending from a shoulder section to terminate at a thumb section, wherein the thumb section is located at a distal end of each of the first and second portions and extends with a greater transverse width than the rack section, the rack section being formed with a toothed outer edge, each shoulder section being configured to retentively engage a stop section formed on the main body for limiting entry into the cavity of one of the first and second end portions of the strap, each thumb section being configured to retentively engage a restriction section formed on the main body for preventing escape of one of the first and second end portions of the strap from the cavity; and a controller displaceably mounted in the cavity for selectively engaging the toothed sections of the cavity, the controller having at least one cantilever and a gear engaged with the rack sections of the strap, wherein responsive to rotating the controller, the rack sections are driven to move the first and second end portions of the strap.

2. The head circumference adjustment device of the helmet as claimed in claim 1, wherein the main body is a rectangular case, two ends of the main body being formed with inlets for the strap to enter the main body, the peripheral wall bounding the cavity being formed with the first and second slots communicating with the cavity, the thumb section being greater in height than the rack section.

3. The head circumference adjustment device of the helmet as claimed in claim 2, wherein the first slot is positioned on an upper section of the cavity and the second slot is positioned on a lower section of the cavity, and a third slot and a fourth slot are respectively positioned on upper and lower sections of the cavity.

4. The head circumference adjustment device of the helmet as claimed in claim 3, wherein the main body is formed with a first rail between the inlets and the first slot and the third slots and a second rail between the inlets and the second slot and the fourth slots, the first and second rails serving to guide the strap to move in a moving path, the first and second rails being respectively provided with the stop section in the moving path of the strap, the first and second rails being further provided with the restriction section formed on the main body in the moving path of the strap.

5. The head circumference adjustment device of the helmet as claimed in claim 4, further comprising a back cover assembled with the main body, the back cover being formed with first and second rails corresponding to the first and second rails of the main body, and stop sections corresponding to the stop sections of the main body, the back cover and the main body thereby being closely mated with each other.

6. The head circumference adjustment device of the helmet as claimed in claim 4, wherein the strap is in an annular form and the first and second ends portions overlap each other in mutually spaced manner, the first end entering the main body from the inlet and extending along the first rail through the first slot into the cavity and then passing through the third slot, the second end entering the main body from the other inlet and extending along the second rail through the second slot into the cavity and then passing through the fourth slot.

7. The head circumference adjustment device of the helmet as claimed in claim 4, wherein the restriction section of the first rail is adjacent to the third slot and the restriction section of the second rail is adjacent to the fourth slot, the third and fourth slots having a vertical height larger than the height of the rack sections of the strap, but smaller than the height of the thumb sections of the strap.

8. The head circumference adjustment device of the helmet as claimed in claim 2, wherein the main body is formed with a first rail and a second rail between the inlets and the first and second slots, the first and second rails serving to guide the strap to move in a moving path, the first and second rails being respectively provided with the stop section in the moving path of the strap, the first and second rails being further provided with the restriction section formed on the main body in the moving path of the strap.

9. The head circumference adjustment device of the helmet as claimed in claim 8, further comprising a back cover assembled with the main body, the back cover being formed with first and second rails corresponding to the first and second rails of the main body, and stop sections corresponding to the stop sections of the main body, the back cover and the main body thereby being closely mated with each other.

10. The head circumference adjustment device of the helmet as claimed in claim 8, wherein the restriction section of the first rail is adjacent to the first slot and the restriction section of the second rail is adjacent to the second slot, the first and second slots having a vertical height larger than the height of the rack sections of the strap, but smaller than the height of the thumb sections of the strap.

11. The head circumference adjustment device of the helmet as claimed in claim 1, further comprising a back cover assembled with the main body, the back cover being a planar board body corresponding in configuration to the main body, the back cover being formed with claw sections and insertion blocks at two ends, the claw sections being inserted in sockets formed on the bottom section of the cavity, the insertion blocks being inserted in dents formed at two ends of the main body.

12. The head circumference adjustment device of the helmet as claimed in claim 11, wherein a subsidiary cover is connected with the back cover.

13. The head circumference adjustment device of the helmet as claimed in claim 1, wherein the controller is a tray-shaped member formed with a shaft hole, a shaft of an adjustment button being assembled in the shaft hole by means of a fastening member to connect the controller with the adjustment button.

14. The head circumference adjustment device of the helmet as claimed in claim 13, wherein the cantilever of the controller is elastically displaceable, the cantilever being formed with a recessed section and a restriction section formed at a free end of the cantilever, the restriction section having a wedged configuration defining a first face and a second face.

15. The head circumference adjustment device of the helmet as claimed in claim 14, wherein the adjustment button has at least one press section positioned on the recessed section.

16. The head circumference adjustment device of the helmet as claimed in claim 15, wherein the press section is a boss.

17. The head circumference adjustment device of the helmet as claimed in claim 1, wherein the cantilever of the controller is elastically displaceable, the cantilever being formed with a recessed section and a restriction section formed at a free end of the cantilever, the restriction section having a wedged configuration defining a first face and a second face.

18. The head circumference adjustment device of the helmet as claimed in claim 17, wherein the controller has two symmetrical cantilevers.

19. The head circumference adjustment device of the helmet as claimed in claim 17, wherein the first face of the restriction section of the cantilever and an axis of the cantilever contain an angle smaller than an angle contained between the second face and the axis of the cantilever.

20. The head circumference adjustment device of the helmet as claimed in claim 19, wherein the second face of the restriction section of the cantilever engages with the toothed sections of the cavity to block rotation of the controller.

21. The head circumference adjustment device of the helmet as claimed in claim 19, wherein the first face of the restriction section of the cantilever slidably contacts the toothed sections of the cavity during rotation of the controller.

22. The head circumference adjustment device of the helmet as claimed in claim 1, wherein the thumb section of the strap provides an elastic action force.

23. The head circumference adjustment device of the helmet as claimed in claim 1, wherein the thumb sections have a slope.

24. The head circumference adjustment device of the helmet as claimed in claim 1, wherein the adjustment device is mounted in a helmet body.

25. The head circumference adjustment device of the helmet as claimed in claim 24, wherein the helmet body is formed with an assembling hole, an adjustment button of the adjustment device being movably assembled in the assembling hole of the helmet body.

* * * * *